US008850705B2

(12) United States Patent
Steigert et al.

(10) Patent No.: US 8,850,705 B2
(45) Date of Patent: Oct. 7, 2014

(54) PROCESSES FOR PRODUCING EXHAUST GAS MANIFOLDS

(75) Inventors: Andreas Steigert, Lambrecht (DE); Thomas Weidner, Edenkoben (DE); Georg Reuther, Hochstadt (DE); Lan Huynh, Neustadt (DE); Juergen Rickertsen, Lambrecht (DE)

(73) Assignee: Heinrich Gillet GmbH, Edenkoben (DE)

( * ) Notice: Subject to any disclaimer, the term of this patent is extended or adjusted under 35 U.S.C. 154(b) by 1868 days.

(21) Appl. No.: 11/798,168

(22) Filed: May 10, 2007

(65) Prior Publication Data

US 2008/0098599 A1 May 1, 2008

(30) Foreign Application Priority Data

May 10, 2006 (DE) ..... 10 2006 021 674

(51) Int. Cl.
*B21D 51/16* (2006.01)
*B21D 53/88* (2006.01)
*F01N 13/10* (2010.01)

(52) U.S. Cl.
CPC ..... *B21D 53/88* (2013.01); *F01N 13/10* (2013.01); *F01N 2470/14* (2013.01); *F01N 2470/10* (2013.01)
USPC ..... 29/890.08; 123/65 EM; 60/323

(58) Field of Classification Search
CPC ..... F01N 13/08; F01N 13/10; F01N 13/18; F01N 13/1805; F01N 2450/20; F01N 2470/02; F02B 27/04
USPC ..... 29/890.08, 890.148, 890.149; 60/276, 60/323, 313; 123/195 A, 195 R, 65 EM
See application file for complete search history.

(56) References Cited

U.S. PATENT DOCUMENTS

| | | | | | |
|---|---|---|---|---|---|
| 2,131,509 | A | * | 9/1938 | Donahue et al. | 285/347 |
| 4,484,440 | A | * | 11/1984 | Oki et al. | 60/276 |
| 4,815,274 | A | * | 3/1989 | Piatti | 60/313 |
| 4,833,882 | A | | 5/1989 | Yasuda et al. | |
| 4,864,978 | A | * | 9/1989 | Fukazawa | 123/184.61 |
| 5,727,386 | A | * | 3/1998 | Watanabe et al. | 60/323 |
| 5,787,709 | A | * | 8/1998 | Watanabe et al. | 60/313 |
| 6,026,570 | A | * | 2/2000 | Bohm et al. | 29/890.08 |
| 6,038,769 | A | * | 3/2000 | Bonny et al. | 29/890.08 |
| 6,122,911 | A | * | 9/2000 | Maeda et al. | 60/323 |
| 6,199,376 | B1 | * | 3/2001 | Maeda | 60/323 |
| 2002/0014007 | A1 | * | 2/2002 | Bonny et al. | 29/890.08 |

FOREIGN PATENT DOCUMENTS

DE 9417043 U 1/1995

* cited by examiner

*Primary Examiner* — Ryan J Walters
(74) *Attorney, Agent, or Firm* — Muncy, Geissler, Olds & Lowe, P.C.

(57) ABSTRACT

A process for producing exhaust gas manifolds is provided, which have a flange for fastening to the cylinder head of an internal combustion engine, manifold pipes for leading off the exhaust gases flowing from the cylinders, and a pipe connector, wherein the pipe connector has openings for the manifold pipes. In accordance with the invention, the pipe connector is designed with reinforced openings. Then the ends of the manifold pipes are introduced into the openings and expanded. In this process, the pipe ends undergo plastic deformation, and the pipes are connected gas-tight.

11 Claims, 2 Drawing Sheets

PROCESSES FOR PRODUCING EXHAUST GAS MANIFOLDS

This nonprovisional application claims priority under 35 U.S.C. §119(a) to German Patent Application No. DE 10 2006 021 674, which was filed in Germany on May 10, 2006, and which is herein incorporated by reference.

BACKGROUND OF THE INVENTION

1. Field of the Invention

The present invention relates to processes for producing exhaust gas manifolds that have a flange for fastening to the cylinder head of an internal combustion engine, manifold pipes for leading off the exhaust gases flowing out from the cylinders, and a pipe connector, wherein the pipe connector has openings for the manifold pipes.

2. Description of the Background Art

Exhaust gas manifolds typically include a flange, which is fastened to the cylinder head of an internal combustion engine, and a number of manifold pipes corresponding to the number of cylinder outlets for leading off the exhaust gases flowing out from the cylinders. The ends of the manifold pipes are brought together, so that all exhaust gases pass through further components of the exhaust system, e.g., catalysts, diesel soot filters, and mufflers. For this purpose, the ends of the manifold pipes, depending on the engine design, are designed as 3-into-1, 4-into-1 or 4-into-2-into-1 connectors.

DE 94 17 043 U discloses the bringing together of 4 manifold pipes. For this purpose, the pipe ends are deformed such that they form the 4 quadrants of a circle. As soon as the gap between the pipe ends is welded together gas-tight, the combination is complete.

In practice it has been found that because of tolerances in the pipe dimensions themselves or because of tolerances that occur during the forming of the pipes and the pipe ends, gaps form, which can only be closed by additional welding work. This is disadvantageous.

Additional drawbacks of the welding process are weld spatters, which break off later during operation of the exhaust system and can destroy mechanically sensitive components of the exhaust system, especially ceramic monoliths and soot filters. Also problematic are contaminations that can occur during welding. This leads to the fact that the welded exhaust manifolds must be washed and cleaned, which considerably increases the production costs. This is extremely unsatisfactory.

Naturally, there has been no lack of attempts to eliminate these problems by changing the design. For example, U.S. Pat. No. 4,833,882 shows a pipe connector for manifold pipes, formed by a massive casting, which has a separate connection port for each manifold pipe end. In addition, a connection port for a lambda probe is provided. The connection to the subsequent pipes is provided by a massive flange plate. Although the tolerance problem is somewhat reduced by this, the problems associated with welding remain. In addition, there is the relatively high weight.

SUMMARY OF THE INVENTION

It is therefore an object of the present invention to provide a process with the aid of which the problems mentioned can be eliminated in the manufacturing of exhaust manifolds.

This goal is accomplished by a process for producing exhaust manifolds which have a flange for fastening to the cylinder head of an internal combustion engine, manifold pipes for leading off the exhaust gases flowing out from the cylinders, and a pipe connector, wherein the pipe connector has openings for the manifold pipes, characterized in that the pipe connector is designed with reinforced openings, that the ends of the manifold pipes introduced into the openings are enlarged and plastically deformed, and that the pipes are connected gas-tight.

The present invention solves the problem in that the ends of the manifold pipes are first inserted into reinforced openings of a connector pipe and then are enlarged and plastically deformed in this process. On the basis of the plastic deformation, the pipe ends maintain their shape, exactly adapted to the openings, so that the subsequent gas-tight connection of the manifold pipe ends with the pipe connector can take place by a simple, fully automated process. In this way, even non-circular cross sections can be easily realized.

In accordance with an embodiment of the invention, the connection between the manifold pipe ends and the pipe connector is accomplished by soldering, especially hard-soldering, or alternatively by gluing.

As needed, the pipe connector may be designed as a three-dimensional hollow body or as a flat disk.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
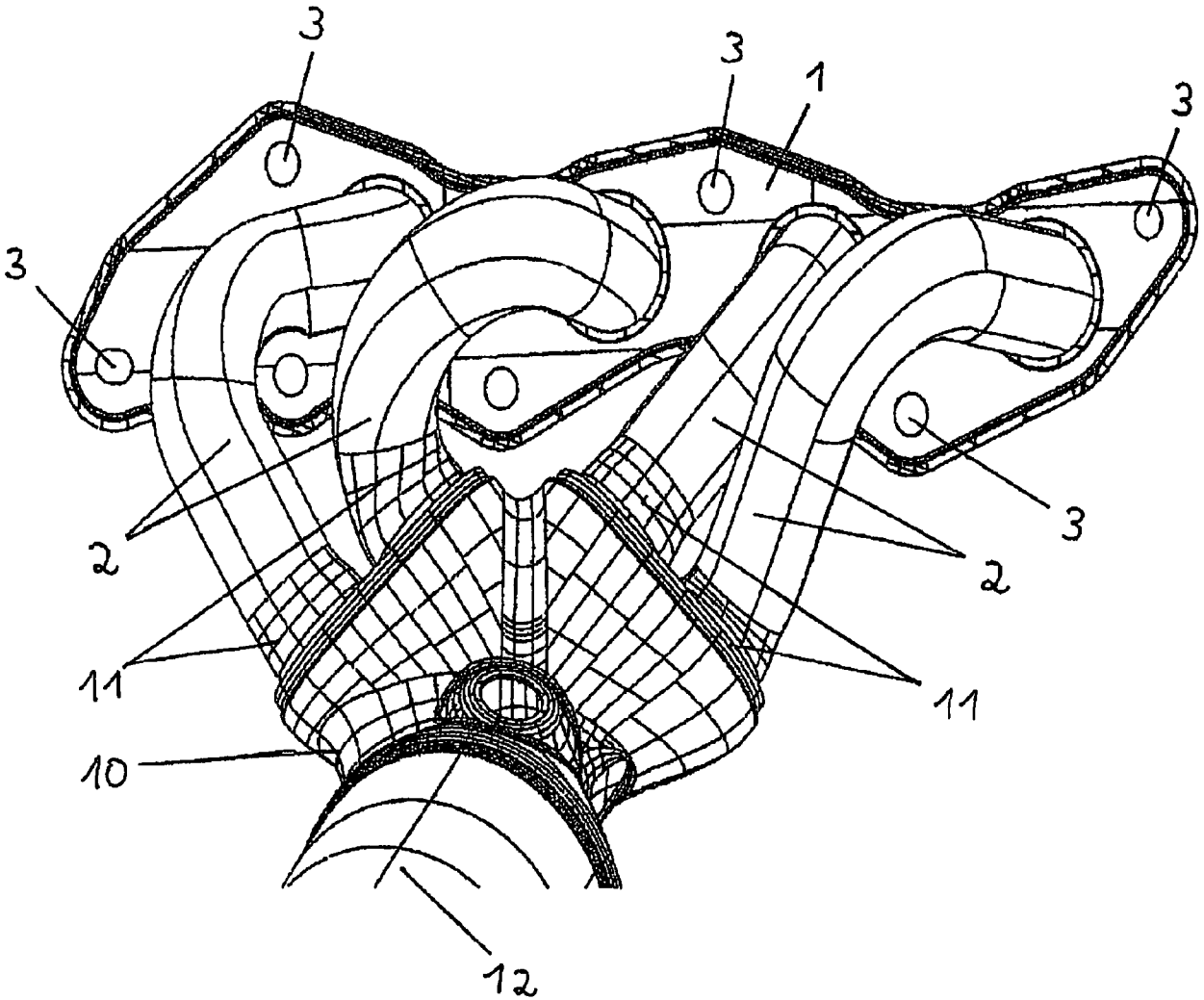
FIG. 1 an exhaust manifold with a 4-into-1 connector for the manifold pipes and FIG. 2 an exhaust manifold with a 3-into-1 connector.

FIG. 1 shows, purely schematically in isometric and partially transparent view, an exhaust manifold for a four-cylinder engine. One can see a flange 1 for fastening to the cylinder head of an internal combustion engine (not shown), to which four manifold pipes 2 are fastened. The four manifold pipes 2 are conducted into a three-dimensionally formed pipe connector 10. In this process, the manifold pipes 2 are curved three-dimensionally such that the openings 3 provided in the flange 1 for fastening screws 4 (FIG. 2) remain readily accessible.

The three-dimensional pipe connector 10 has openings 11 for the ends of the manifold pipes 2. Here, these openings 11 are reinforced. In this process it is possible to enlarge the inserted ends of the manifold pipes 2, using an expansion tool (not shown), to the point where they completely fill the openings 11. Since the ends of the manifold pipes 2 are plastically deformed during enlargement, they retain their shape after removal of the expansion tool.

Thanks to the enlargement process, it is possible without further effort to design the openings 11 in almost any arbitrary form. To keep the gaps between the manifold pipes 2 and the pipe connector 10 as uniformly small as possible, it is advisable not to provide a sharp radii.

The gas-tight connection between the ends of the manifold pipes 2 and the pipe connector 10 is preferably accomplished by soldering, especially hard-soldering, since in this connection process, no splashes are produced and any contaminations on the metal surfaces burn off.

An alternative connection method with comparable advantages is adhesive bonding, assuming that a sufficiently heat-resistant adhesive is used.

Figure 2:
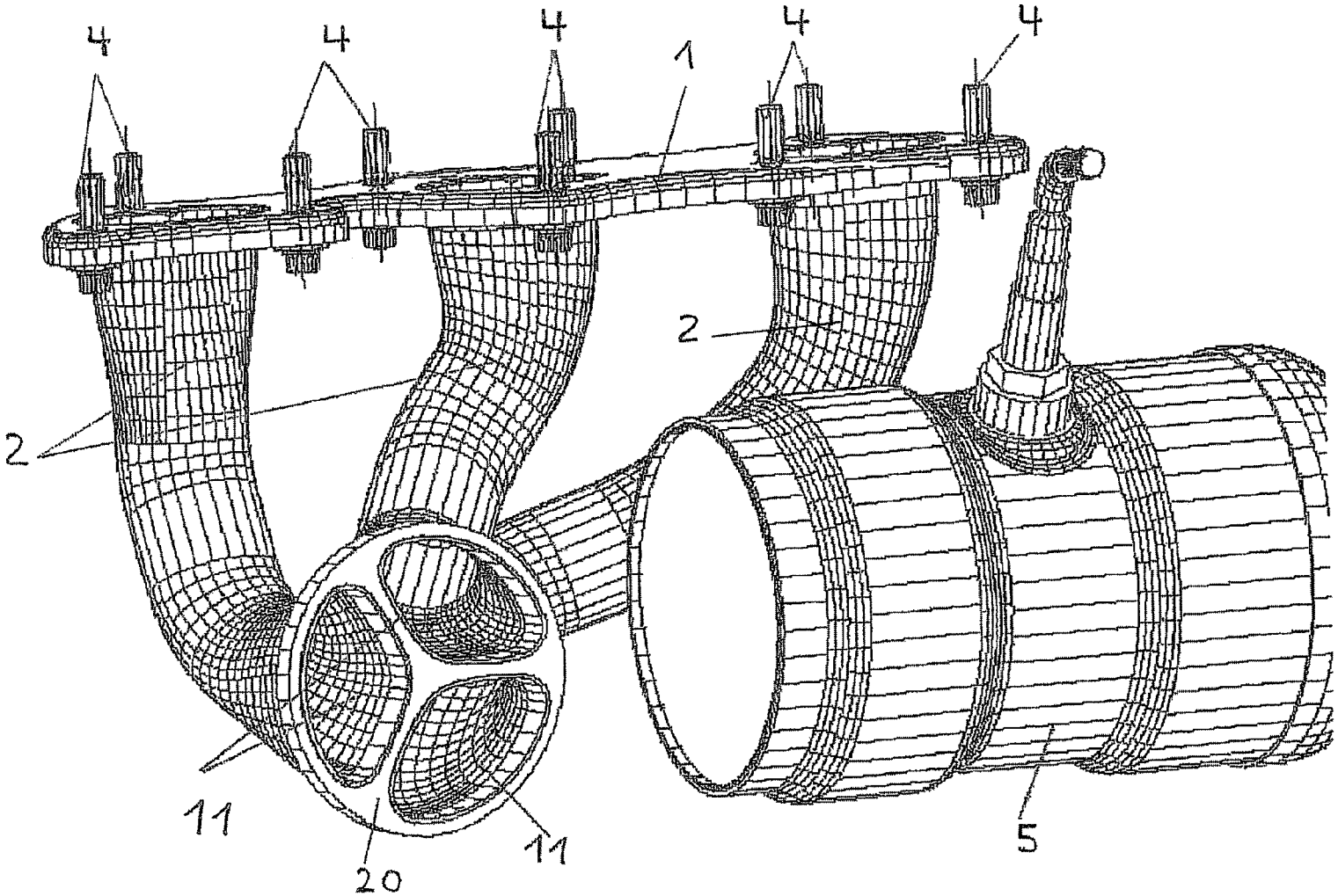

FIG. 2 shows a further embodiment of an exhaust manifold with a flange 1, manifold pipes 2 and an alternative pipe connector 20. This includes a reinforced disk in which three off-round openings 11 are provided. The manifold pipes 2 themselves have circular cross sections. The ends of the manifold pipes 2 are enlarged with the aid of an expansion tool (not shown) such that they completely fill the off-round openings 11.

The pipe connector 20 is followed, for example, by an exhaust gas catalyst housing 5, so that the exhaust gases flowing in from the three manifold pipes 2 are purified together.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A process for producing exhaust gas manifolds, which have a flange for fastening to a cylinder head of an internal combustion engine, manifold pipes fastened at a first end to the cylinder head for leading off exhaust gases flowing from the cylinder head, and a pipe connector, wherein the pipe connector has non-circular openings for connecting to a second end of each manifold pipe, the process comprising:

reinforcing the non-circular openings of the pipe connector, a number of the reinforced non-circular openings formed in the pipe connector corresponding to a number of manifold pipes;

inserting the second ends of the manifold pipes into the reinforced non-circular openings of the pipe connector; and expanding the second ends of the manifold pipes that are introduced into the reinforced non-circular openings of the pipe connector with the aid of an expansion tool, thereby undergoing plastic deformation such that each of the second ends of the manifold pipes are fitted completely gas-tight into the reinforced non-circular openings of the pipe connector.

2. The process according to claim 1, wherein the pipe connector is designed as a 3-dimensional hollow piece.

3. The process according to claim 1, wherein the pipe connector is designed as a flat disk.

4. The process according to claim 1, wherein the manifold pipes and the pipe connector are welded together.

5. The process according to claim 1, wherein the manifold pipes and the pipe connector are bonded together with adhesive.

6. The process according to claim 1, wherein the manifold pipes and the pipe connector are soldered together.

7. A process for producing exhaust gas manifolds, which have a flange for fastening manifold pipes to a cylinder head of an internal combustion engine, each manifold pipe fastened at a first end to the cylinder head for leading off exhaust gases flowing from the cylinder head, and a pipe connector, wherein the pipe connector is designed as a flat reinforced disk and has one off-round opening for each manifold pipe for receiving a second end of each respective manifold pipe, the process comprising:

reinforcing the off-round openings of the pipe connector;

inserting the second ends of the manifold pipes into the reinforced off-round openings of the pipe connector;

enlarging the second ends of the manifold pipes that are inserted into the off-round openings of the pipe connector with the aid of an expansion tool, thereby undergoing plastic deformation such that they completely fill the off-round openings; and connecting the manifold pipes and the pipe connector gas-tight.

8. The process according to claim 7, wherein the manifold pipes and the pipe connector are connected together by soldering.

9. The process according to claim 7, wherein the manifold pipes and the pipe connector are connected together by welding.

10. The process according to claim 7, wherein the manifold pipes and the pipe connector are bonded together with adhesive.

11. A process for producing exhaust gas manifolds, the process comprising:

providing a plurality of manifold pipes having a first end and a second end, the manifold pipes adapted to lead off exhaust gases flowing from a cylinder head of an internal combustion engine;

providing a flange that is adapted to fixedly hold the first end of each of the manifold pipes thereon, the flange being configured to be mounted to the cylinder head;

providing a pipe connector having a plurality of non-circular reinforced openings;

inserting the second end of each of the manifold pipes into a corresponding reinforced opening of the pipe connector; and expanding the second end of each of the manifold pipes via an expansion tool such that each of the second ends of the manifold pipes is plastically deformed so that an outer perimeter of the second end directly and completely contacts an inner perimeter of each of the non-circular reinforced openings so that exhaust gas is prevented from flowing between the outer perimeter and the inner perimeter.

* * * * *